United States Patent [19]

Burhans

[11] 3,949,915

[45] Apr. 13, 1976

[54] WAIST ATTACHMENT FOR HANDBAG INCLUDING SHOULDER BAG

[76] Inventor: Edna K. Burhans, 1809 Brickell Ave., Miami, Fla. 33129

[22] Filed: Oct. 2, 1974

[21] Appl. No.: 511,181

[52] U.S. Cl. ..... 224/26 K; 24/3 M; 24/84 A; 150/47; 224/26 D

[51] Int. Cl.[2] ..... A45C 1/04

[58] Field of Search ..... 224/26 D, 26 K, 26 R, 27, 224/5 R, 5 A, 5 B, 26 B; 150/47; 191/61; 24/3 M, 3 R, 84 A, 205.15 H, 30.5 L

[56] References Cited

UNITED STATES PATENTS

| | | | |
|---|---|---|---|
| 1,213,758 | 1/1917 | Delaney | 150/47 |
| 1,298,278 | 3/1919 | Bashinski | 150/47 |
| 2,783,926 | 3/1957 | Wise | 224/26 K |
| 3,126,598 | 3/1964 | Gottschalk | 150/47 X |

FOREIGN PATENTS OR APPLICATIONS

| | | | |
|---|---|---|---|
| 143,132 | 10/1935 | Austria | 24/3 K |

*Primary Examiner*—Robert J. Spar
*Assistant Examiner*—Jerold M. Forsberg
*Attorney, Agent, or Firm*—Clarence A. O'Brien; Harvey B. Jacobson

[57] ABSTRACT

A downwardly opening hollow receptacle is provided for attachment to a portion of a person's body by means of a belt or similar support secured about or otherwise supported from the body portion with the receptacle mounted from the belt. The upper end of the receptacle is closed except for a small diameter opening and a short length flexible anchor member is provided and is slidingly received through the small diameter opening. The end portion of the anchor member passing downwardly through the interior of the receptacle is provided with a releasable catch assembly for releasably anchoring engagement with a selected portion of a handbag, purse or shoulder bag. One side of the receptacle is provided with an anchor element and the end of the anchor member remote from the releasable catch is provided with a terminal end releasably engageable with the anchor element. The anchor element is supported from a lower portion of the receptacle and the terminal end of the anchor member releasably engageable with the anchor element is of a size to be prevented from passing through the aforementioned small diameter opening. Further, the effective length of the flexible anchor member is such that when the terminal end of the anchor member remote from the releasable catch assembly is engaged with the anchor element the releasable catch assembly is retracted upwardly into the interior of the receptacle.

6 Claims, 5 Drawing Figures

WAIST ATTACHMENT FOR HANDBAG INCLUDING SHOULDER BAG

BACKGROUND OF THE INVENTION

Heretofore various types of devices have been designed for use in releasably anchoring various forms of purses to waist encircling belts. However, at least some of these previously designed devices have certain drawbacks which render them impractical or inoperative in present day use.

BRIEF DESCRIPTION OF THE INVENTION

The invention includes a downwardly opening receptacle for support from a body portion of the user and includes a releasable catch assembly for releasable engagement with a handbag, purse or shoulder bag and the releasable catch assembly is supported from the receptacle for shifting between a position spaced below the open end of the receptacle and an out of the way position retracted upwardly into the receptacle and thus protected against unauthorized release from the associated handbag, purse or shoulder bag.

The main object of this invention is to provide a means whereby a person may securely attach a handbag, purse or shoulder bag to her person against dislodgment by a purse snatcher.

Another object of this invention in accordance with the immediately preceding object is to provide an apparatus constructed in a manner whereby it may be readily utilized with various types of outdoor attire.

A still further object of this invention is to provide a guard against purse snatchers which will be effective in accomplishing its purpose, and yet which will not be objectionable from an appearance standpoint.

A final object of this invention to be specifically enumerated herein is to provide an apparatus in accordance with the preceding objects and which will conform to conventional forms of manufacture, be of simple construction, and easy use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings, forming a part hereof, wherein like numerals refer to like parts throughout.

DETAILED DESCRIPTION OF THE INVENTION

Figure 1:
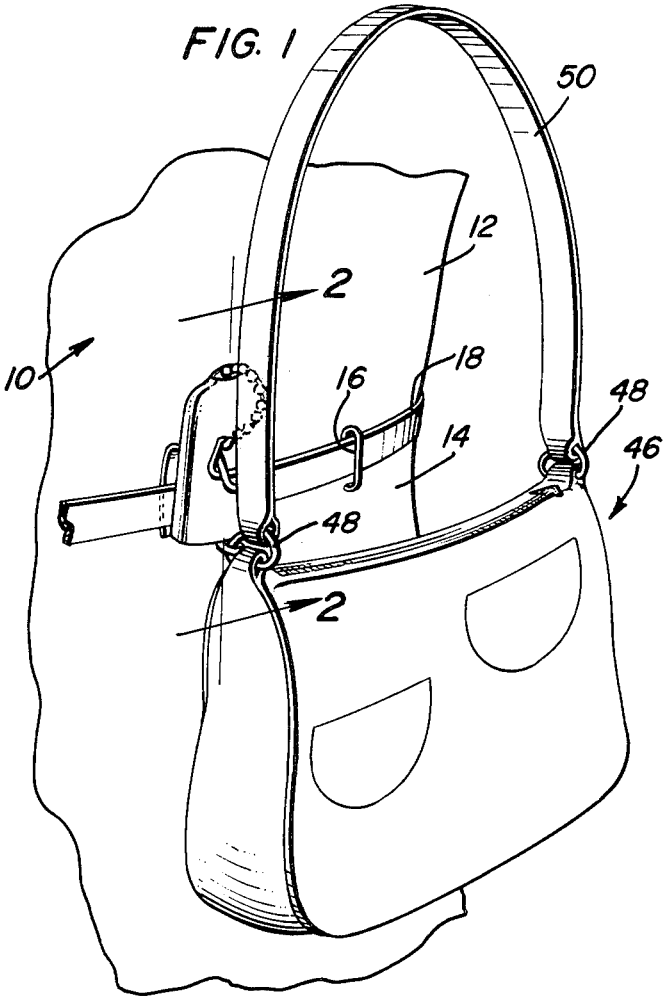
FIG. 1 is a fragmentary perspective view of one side of the waist area of a person utilizing the instant invention for with a substantial belt included attaching a shoulder bag to the person.

Referring now more specifically to the drawings the numeral 10 generally designates a user of the instant invention suitably clothed in wearing apparel 12 having a waist portion 14 equipped with belt supporting loops 16 and with a substantial belt 18 passed through the belt supporting loops 16. The anchor attachment for handbags, purses or shoulder bags is referred to in general by the reference numeral 20 and includes a hollow downwardly opening receptacle 22 including inner and outer sides 24 and 26 interconnected at their upper ends by means of an integral top wall portion 28 having a small diameter opening 30 formed therethrough. The corresponding side edges of the front and rear sides 24 and 26 are suitably joined as at 32 and 34 and the outer side of the rear side 26 is provided with a downwardly opening support clip 36 for engagement over the belt 18 in a manner which is believed to be obvious from FIGS. 1, 2 and 3 of the drawings.

The outer side of the front side or wall 24 of the receptacle 22 includes a downwardly opening anchor hook 35 and a short length of flexible anchor member 38 is slidingly received through the aperture or opening 30. The end portion of the anchor member 38 projecting upwardly through the opening 30 is equipped with an anchor ring 40 and the end portion of the anchor member 38 projecting downwardly through the hollow interior of the receptacle 22 is equipped with a releasable swivel catch assembly 44 of conventional design at its terminal end.

Figure 2:
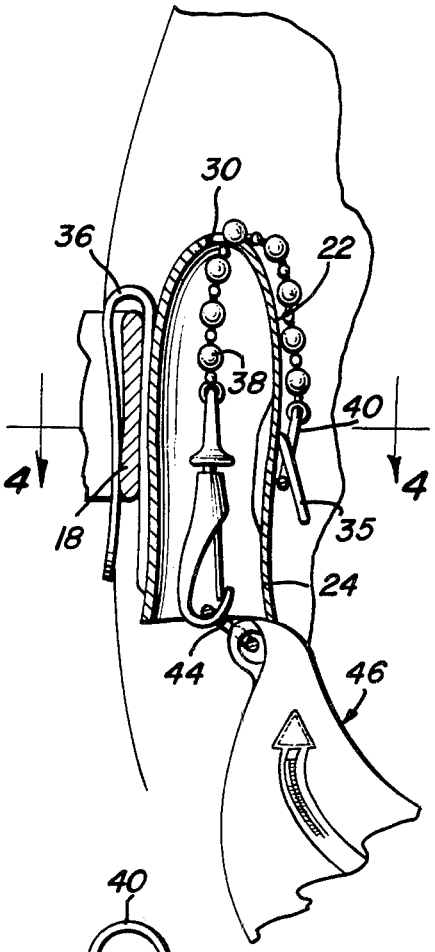
FIG. 2 is a enlarged fragmentary vertical sectional view taken substantially upon the plane indicated by the section line 2—2 of FIG. 1.
Figure 5:
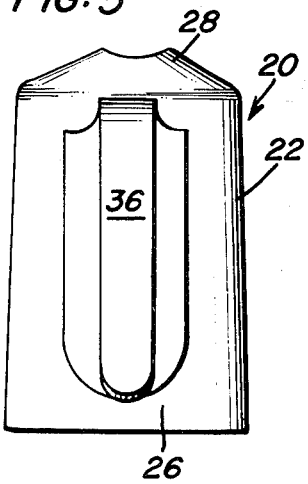
FIG. 5 is a rear elevational view of the receptacle portion of the invention.
Figure 4:
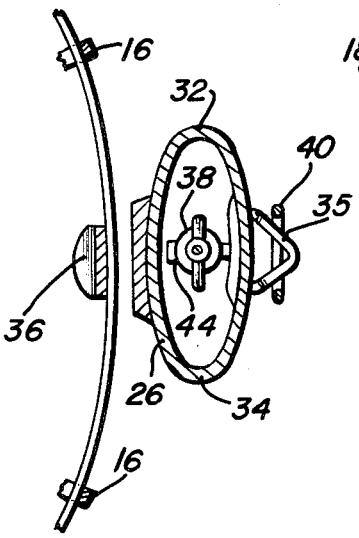
FIG. 4 is a horizontal sectional view taken substantially upon the plane indicated by the section line 4—4 of FIG. 2.
Figure 3:
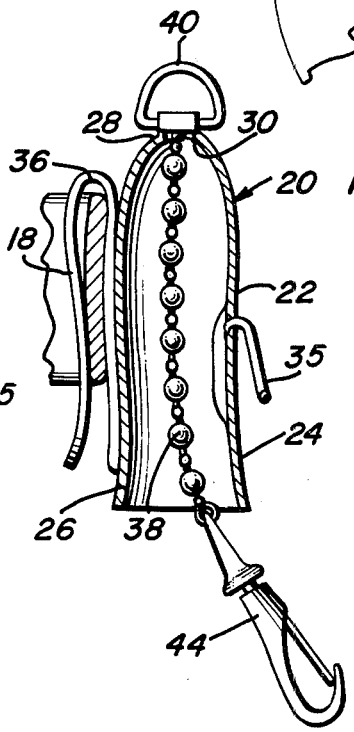
FIG. 3 is a fragmentary vertical sectional view similar to FIG. 2 but with the purse anchoring portion of the instant invention in position to allow easy release from engagement with an associated handbag, purse or shoulder bag.

In operation, the attachment 20 is removably attached to the waist encircling belt 18 by means of the spring clip 36 in a manner believed to be obvious from FIGS. 1, 2 and 3 of the drawings. Thereafter, when it is desired to releasably anchor a shoulder bag such as the shoulder bag 46 to the attachment 20 (the shoulder bag 46 including anchor rings 48 to which the opposite ends of the shoulder strap 50 thereof are secured) the ring 40 is disengaged from the hook 35 and the anchor member 38 is allowed to slide downwardly through the opening or bore 30 until the ring 40 abuts the outer surfaces of the upper end wall 28 of the receptacle 22. Then, with the releasable catch assembly 44 spaced below the open lower end of the receptacle 22, the releasable catch assembly 44 is engaged with one of the anchor rings 48, and the ring 40 is then displaced upwardly to retract the catch assembly 44 into the interior of the receptacle 22 in the manner illustrated in FIG. 2 of the drawings. Thereafter, the upper end of the flexible anchor member 38 is deflected downwardly and outwardly over the outer surface of the front side 24 of the receptacle 22 and the eye or ring 40 is releasably engaged with the hook 35. In this manner, the releasable catch assembly 44 is fully retracted within the receptacle 22 and thus obscured from manipulation by a purse snatcher.

Of course, the spring clip 36 may be of a type that requires considerable manipulation in order to disengage the clip 36 from the belt 18. Further, the ring or eye 40 and the hook 35 may include coacting portions which also require more than casual manipulation to release the eye 40 from the hook 35. In any event, the attachment 20 serves to securely fasten the shoulder bag 46 to belt 18 and to thus prevent a purse snatcher from snatching handbag 46.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A safety attachment for securement to a person's body and for releasably anchoring a handbag, purse or shoulder bag to that person in a manner to foil a purse snatching attempt, said attachment comprising a housing defining a receptacle opening in a downward direction and closed at its upper end to the exclusion of a small diameter opening, an elongated flexible anchor member slidably received through said opening with a first end portion of said anchor member disposed within said receptacle and a second end portion disposed outwardly of said receptacle, each end portion of said anchor member including means defining an enlargement thereon incapable of being passed through said opening, said receptacle including anchor means for anchoring the receptacle to a person's body, one side wall of said receptacle including a first anchor element, the second end portion of said anchor member including a second anchor element releasably anchorable to said first anchor element, the first end portion of said anchor member including releasable clip means for releasably engaging a predetermined anchor point on an associated purse, handbag or shoulder bag, said first anchor element being supported from a lower portion of said receptacle, and the length of said anchor member being such that when said anchor elements are engaged with each other said clip means will be retracted upwardly into the interior of said receptacle and when said second anchor element is released from engagement with said first anchor element and the enlargement on said second end portion is engaged with the portions of said receptacle defining said small diameter opening said clip means may be downwardly withdrawn from the open lower end of said receptacle, said anchor means including a belt engageable clip for removable support of said attachment from the belt of the user.

2. The combination of claim 1 wherein said clip means is attached to the corresponding end of said anchor member by means of a swivel structure.

3. The combination of claim 1 wherein said first anchor element comprises a downwardly opening hook.

4. The combination of claim 3 wherein said second anchor element comprises an anchor ring releasably engageable with said hook.

5. The combination of claim 4 wherein said clip means is attached to the corresponding end of said anchor member by means of a swivel structure.

6. A safety attachment for anchoring to an object and for releasably securing an article to that object in a manner to foil an attempted theft of the article, said attachment comprising a hollow housing including a first closed end and a second open end and defining a receptacle opening outwardly of said second end, said closed end including a small diameter opening formed therein, an elongated flexible anchor member slidably received through said small diameter opening with a first end portion of said anchor member disposed within said receptacle and a second end portion disposed outwardly of said receptacle, each end portion of said anchor member including means defining an enlargement thereon incapable of being passed through said small diameter opening, said receptacle including anchor means for removably anchoring the receptacle to said object, one side wall of said receptacle including a first anchor element, the second end portion of said anchor member including a second anchor element releasably anchorable to said first anchor element, the first end portion of said anchor member including releasable clip means for releasably engaging a predetermined anchor point on an associated article, the length of said anchor member being such that when said anchor elements are engaged with each other said clip means will be retracted into the interior of said receptacle and when said second anchor element is released from engagement with said first anchor element and the enlargement on said second end portion is engaged with the portions of said receptacle defining said small diameter opening said clip means may be outwardly withdrawn from the second open end of said housing.

* * * * *